United States Patent [19]

Uchida et al.

[11] Patent Number: 4,746,412

[45] Date of Patent: May 24, 1988

[54] IRON-PHOSPHORUS ELECTROPLATING BATH AND ELECTROPLATING METHOD USING SAME

[75] Inventors: Hiroki Uchida, Neyagawa; Yosiomi Aoyagi; Tsuyoshi Uotani, both of Hirakata; Yoshio Takagi, Toyota; Shinji Kato, Toyota; Hitoshi Ozawa, Toyota, all of Japan

[73] Assignees: C. Uyemura & Co., Ltd., Osaka; Toyota Jidosha Kabushiki Kaisha, Aichi, both of Japan

[21] Appl. No.: 881,796

[22] Filed: Jul. 3, 1986

[51] Int. Cl.[4] ..... C25D 3/56

[52] U.S. Cl. ..... 204/44.7

[58] Field of Search ..... 204/44.7; 106/1.27; 427/437

[56] References Cited

U.S. PATENT DOCUMENTS 3,061,525 10/1962 Grazen ..... 204/9
3,178,311 4/1965 Cann ..... 427/437
4,101,389 7/1978 Uedaira ..... 204/44
4,533,441 8/1985 Gamblin ..... 204/3

FOREIGN PATENT DOCUMENTS 131994 7/1985 Japan ..... 204/44.7

OTHER PUBLICATIONS

Abner Brenner, "Electrodeposition of Alloys", vol. II, p. 461, (1963).

*Primary Examiner*—G. L. Kaplan
*Attorney, Agent, or Firm*—Birch, Stewart, Kolasch & Birch

[57] ABSTRACT

An Fe-P alloy film is electrodeposited on a workpiece in a bath comprising 20–80 g/l ferrous ion, 0.01–15 g/l hypophosphorous acid and/or a hypophosphite, and 0.05–5 g/l aluminum ion or a bath comprising 20–80 g/l ferrous ion and 0.01–20 g/l phosphorous acid and/or a phosphite, and optionally aluminum ion at 10°–80° C. and 0.5–30 A/dm$^2$. There is obtained a crack-free alloy film having a P content of 0.1 to 9.9 wt %.

17 Claims, 2 Drawing Sheets

IRON-PHOSPHORUS ELECTROPLATING BATH AND ELECTROPLATING METHOD USING SAME

BACKGROUND OF THE INVENTION

This invention relates to an iron-phosphorus electroplating bath from which crack-free iron-phosphorus films can be electroplated.

Electroplated iron-phosphorus films have a higher hardness than electroplated iron films. It is thus expected that slide members such as pistons can be improved in abrasion resistance and galling resistance by forming a plated iron-phosphorus film on the necessary portion of slide members, for example, the skirt of pistons.

Prior art known iron-phosphorus electroplating baths are those comprising a ferrous ion, hypophosphorous acid or a hypophosphite, and optionally, boric acid or ammonium chloride. As long as we have confirmed, electroplating in the conventional iron-phosphorus electroplating baths results in iron-phosphorus films which develop many cracks in their cross section. The occurrence of cracks becomes a bar in applications requiring improved mechanical performance. An iron-phosphorus film electroplated on a workpiece and having cracks developed therein not only displays a remarkably reduced toughness in itself, but also tends to reduce the toughness of the workpiece due to the wedge or notch effect.

SUMMARY OF THE INVENTION

An object of the present invention is to provide an iron-phosphorus electroplating bath from which crack-free iron-phosphorus films can be electroplated.

Another object of the present invention is to provide an electroplating method using such a bath.

A further object of the present invention is to provide a slide member having a sliding film in the form of a crack-free plated iron-phosphorus film.

A still further object of the present invention is to provide a method for making such a slide member.

We have found that when a workpiece is electroplated in a plating bath containing a ferrous ion and hypophosphorous acid and/or a hypophosphite and further having an aluminum ion added or a plating bath containing a ferrous ion and phosphorous acid and/or a phosphite as essential ingredients, there is formed on the workpiece a plated iron-phosphorus film which is free of cracks and has improved mechanical properties. These baths are very effective plating baths for forming plated iron-phosphorus films on such workpieces requiring good mechanical performance as slide members.

We have also found that slide members having iron-phosphorus films formed using these baths, particularly, iron-phosphorus films having a phosphorus content of 0.1 to 9.9% by weight exhibit improved mechanical properties and durability.

Therefore, according to a first aspect of the present invention, there is provided an iron-phosphorus electroplating bath comprising a ferrous ion, hypophosphorous acid and/or a hypophosphite, and an aluminum ion.

According to a second aspect of the present invention, there is provided an iron-phosphorus electroplating bath comprising a ferrous ion and phosphorus acid and/or a phosphite as essential ingredients.

According to a third aspect of the present invention, there is provided a method for electroplating an iron-phosphorus film on a workpiece, comprising immersing the workpiece in a plating bath as set forth in the first aspect, and effecting electroplating at a cathode current density of 0.5 to 30 A/dm$^2$ and a temperature of 10° to 80° C.

According to a fourth aspect of the present invention, there is provided a method for electroplating an iron-phosphorus film on a workpiece, comprising immersing the workpiece in a plating bath as set forth in the second aspect, and effecting electroplating at a cathode current density of 0.5 to 30 A/dm$^2$ and a temperature of 10° to 80° C.

According to a fifth aspect of the present invention, there is provided a slide member having a sliding film in the form of an iron-phosphorus film electrodeposited from a plating bath according to the first aspect.

According to a sixth aspect of the present invention, there is provided a slide member having a sliding film in the form of an iron-phosphorus film electrodeposited from a plating bath according to the second aspect.

According to a seventh aspect of the present invention, there is provided a slide member having a sliding film in the form of an electrodeposited iron-phosphorus film having a phosphorus content of 0.1 to 9.9% by weight.

According to an eighth aspect of the present invention, there is provided a method for making a slide member, comprising forming an electroplated iron-phosphorus film having a phosphorus content of 0.1 to 9.9% by weight on a slide member blank using an iron-phosphorus electroplating bath comprising a ferrous ion, hypophosphorous acid and/or a hypophosphite, and an aluminum ion.

According to a ninth aspect of the present invention, there is provided a method for making a slide member, comprising forming an electroplated iron-phosphorus film having a phosphorus content of 0.1 to 9.9% by weight on a slide member blank using an iron-phosphorus electroplating bath comprising a ferrous ion and phosphorous acid and/or a phosphite.

The slide members according to the present invention are durable and free of cracks and having improved mechanical properties.

BRIEF DESCRIPTION OF THE DRAWINGS

The above and other objects, features, and advantages of the present invention will be more fully understood by reading the following description taken in conjunction with the accompanying drawings, in which.

DETAILED DESCRIPTION OF THE INVENTION

Figure 1:
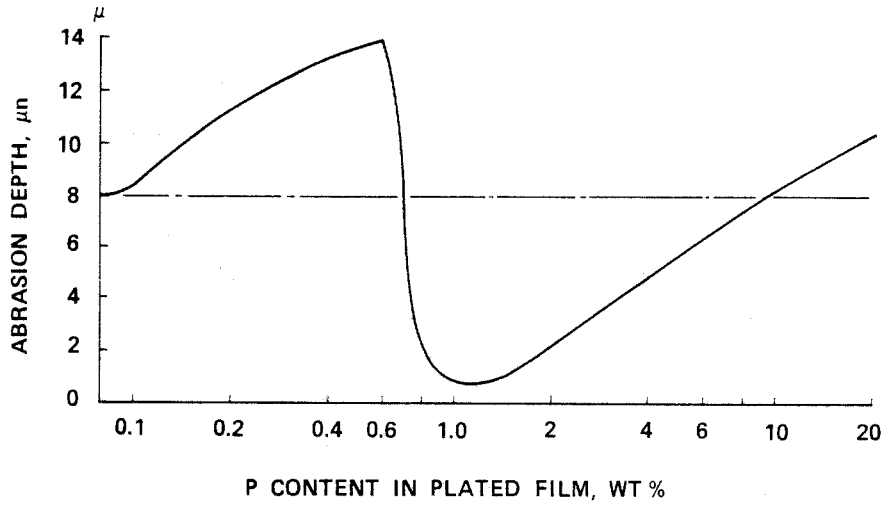
FIG. 1 is a diagram showing abrasion depth (μm) as a function of the phosphorus content (% by weight) in plated iron-phosphorus films.

The present invention provides an iron-phosphorus electroplating bath comprising a ferrous ion, hypophosphorous acid and/or a hypophosphite, and an aluminum ion, and also provides an iron-phosphorus electroplating bath comprising a ferrous ion and phosphorous acid and/or a phosphite as essential ingredients.

Also contemplated in the present invention is a mixture of the aforementioned plating baths, that is, an iron-phosphorus electroplating bath comprising a ferrous ion, hypophosphorous acid and/or a hypophosphite, phosphorous acid and/or a phosphite, and an aluminum ion.

Sources for supplying a ferrous or divalent iron ion are not particularly limited in the practice of the present invention. Examples of the ferrous ion sources include ferrous sulfate, ferrous chloride, ferrous sulfamate, and ferrous borofluoride alone or a mixture of two or more of these compounds. Although the amount of ferrous ion contained in the bath is not particularly limited, it preferably ranges from 20 to 80 grams per liter of the plating bath.

Hypophosphorous acid and hypophosphites are used as a source for supplying phosphorus in the intended iron-phosphorus films. Their amount in the bath varies with the desired phosphorus content of plated iron-phosphorus films, but generally ranges from 0.01 to 15 grams per liter calculated as $NaH_2PO_2.H_2O$, preferably from 0.05 to 10 grams per liter of the plating bath. By changing the concentration of hypophosphorous acid and hypophosphites in the plating bath of the present invention, there is plated an iron-phosphorus film having a phosphorus content of 0.1 to 9.9% by weight. Sodium hypophosphite is a typical example of the hypophosphites used herein.

Phosphorous acid and phosphites are also used as a source for supplying phosphorus in the intended iron-phosphorus films. Their amount in the bath varies with the desired phosphorus content of plated iron-phosphorus films and is limited by their solubility in the bath, but generally ranges from 0.01 to 20 grams per liter calculated as $NaH_2PO_3.2H_2O$, preferably from 0.1 to 10 grams per liter of the plating bath. By changing the concentration of phosphorous acid and phosphites in the plating bath of the present invention, there is plated an iron-phosphorus film having a phosphorus content of 0.05 to 9.9% by weight. Sodium phosphite monobasic is a typical example of the phosphites used herein.

Some illustrative non-limiting examples of aluminum ion sources include aluminum sulfate, aluminum chloride, and aluminum alum. In the practice of the present invention, these aluminum compounds may be used alone or in admixture of two or more. The amount of aluminum ion contained preferably ranges from 0.05 to 5 grams per liter, more preferably from 0.1 to 2 grams per liter of the plating solution because the effect of crack prevention by aluminum ion becomes significant within this range. The crack preventing effect is not fully exerted with less than 0.05 gram/liter of aluminum ion. Excessive amounts of aluminum ion of more than 5 gram/liter tend to deteriorate the adherence between the plated film and the workpiece or matrix.

The aluminum ion is an essential constituent when the phosphorus source used is hypophosphorous acid or hypophosphites. That is, the combined use of hypophosphite and aluminum ion is effective in preventing cracks to generate in plated iron-phosphorus films. On the contrary, when the phosphorus source used is phosphorous acid or phosphites, it is not necessarily required to add an aluminum ion to the bath. Preferably, an aluminum ion is used in combination with phosphorous acid or phosphites because the occurrence of cracks is more effectively prevented.

In addition to the above-mentioned ingredients, if desired, the plating baths of the present invention may further contain any conventional plating aids, for example, an electric conductivity aid such as ammonium sulfate and ammonium chloride in an amount of 0 to 200 gram/liter, especially 20 to 150 gram/liter, a pH buffer such as boric acid in an amount of 0 to 60 gram/liter, especially 20 to 50 gram/liter, and a ferrous or ferric ion complexing agent such as acidic ammonium fluoride in an amount of 0 to 20 gram/liter, especially 1 to 10 gram/liter.

The plating baths of the present invention may further contain one or more water-insoluble materials selected from metals, water-insoluble inorganic and organic fine particulates, and fibers. Examples of the water-insoluble materials include finely divided metal powders such as powders of Pb, Sn, Mo, Cr, Si, Mo-Ni, Al-Si, Fe-Cr, Pb-Sn, Pb-Sn-Sb, Pb-Sn-Cu, etc.; oxides such as $Al_2O_3$, $SiO_2$, $ZrO_2$, $TiO_2$, $ThO_2$, $Y_2O_3$, $CeO_e$, etc.; nitrides such as $Si_3N_4$, TiN, BN, CBN, etc.; carbides such as TiC, WC, SiC, $Cr_3C_2$, $B_4C$, ZrC, etc.; borides such as $ZrB_2$, $Cr_3B_2$, etc.; carbon allotropes such as fluorinated graphite and diamond; sulfides such as $MoS_2$; other inorganic fine particulates; fluoride resins such as polytetrafluoroethylene, epoxy resins, and rubber latexes; other organic fine particulates; and glass fibers, carbon fibers, various metal whiskers, and other inorganic and organic fibers. Among them, hard or lubricating materials are preferably used particularly when it is intended to plate slide members.

The fine particulates used in the practice of the present invention may preferably have a mean particle size of 0.01 to 200 μm, more preferably 0.1 to 20 μm, and the fibers may preferably be 0.01 to 2000 μm long, more preferably 0.1 to 60 μm long. The particulates and/or fibers may preferably be added to the plating bath in an amount of 5 to 500 gram/liter, more preferably 20 to 100 gram/liter.

The plated film obtained from a composite plating bath having dispersed particulates or fibers as described above has an iron-phosphorus deposit as a matrix phase in which the particulates or fibers are codeposited and dispersed. The codeposited particulates or fibers add their inherent properties to the overall film while the matrix phase of iron-phosphorus deposit maintains its own good mechanical properties.

Further, a water-soluble titanium compound and/or zirconium compound may be added to the plating baths of the present invention to produce composite plated films having more improved abrasion resistance. The titanium and zirconium compounds used herein may be, for example, $Na_2TiF_6$, $K_2TiF_6$, $(NH_4)_2TiF_6$, $Ti(SO_4)_2$, $Na_2ZrF_6$, $K_2ZrF_6$, $(NH_4)_2ZrF_6$, $Zr(SO_4)_2.4H_2O$, etc. and mixtures thereof. The amount of the titanium or zirconium compounds added may be 0.05 to 10 grams, more preferably 0.1 to 5 grams calculated as elemental titanium or zirconium per liter of the plating solution. Smaller amounts of the titanium or zirconium compounds are not effective in improving the abrasion resistance of the resulting plated film. Larger amounts cause the titanium or zirconium compounds to be suspended in the bath rather than dissolved and thus adhere to the plated film surface to give a gritty texture, detracting from the appearance and abrasion resistance.

The plating baths of the present invention are preferably adjusted to pH 0.5 to 3.5.

Any workpieces may be plated in the iron-phosphorus electroplating baths of the present invention at a temperature of 10° to 80° C., preferably 30° to 70° C. and a cathode current density of 0.5 to 30 A/dm$^2$ (ampere per square decimeter), preferably 2 to 20 A/dm$^2$. Agitation of the solution is not necessarily required although the bath may be stirred with a cathode rocker or stirrer. An iron plate is generally used as the anode.

The iron-phosphorus films electrodeposited from the iron-phosphorus electroplating baths of the present invention generally appear to have a semi-bright uniform surface, are free of cracks, and exhibit improved mechanical properties. They may be applied to a variety of uses and particularly useful as a coating on slide members.

A typical example of slide member is a skirt of a piston which is operated for sliding motion in a bore of a high silicon aluminum alloy cylinder. One prior art method for increasing the wear resistance of such a slide member is by depositing an iron-phosphorus film on a slide member blank. Most prior art iron-phosphorus films deposited on slide members have a high phosphorus content of more than 10% by weight. Iron-phosphorus deposits having such a high phosphorus content have been found to have poor galling resistance. We have found that slide members having deposited thereon an iron-phosphorus film with a phosphorus content of 0.1 to 9.9% by weight exhibit remarkably improved abrasion resistance and galling resistance. The plating baths of the present invention ensure to form iron-phosphorus films having a phosphorus content of 0.1 to 9.9% by weight.

Figure 2:
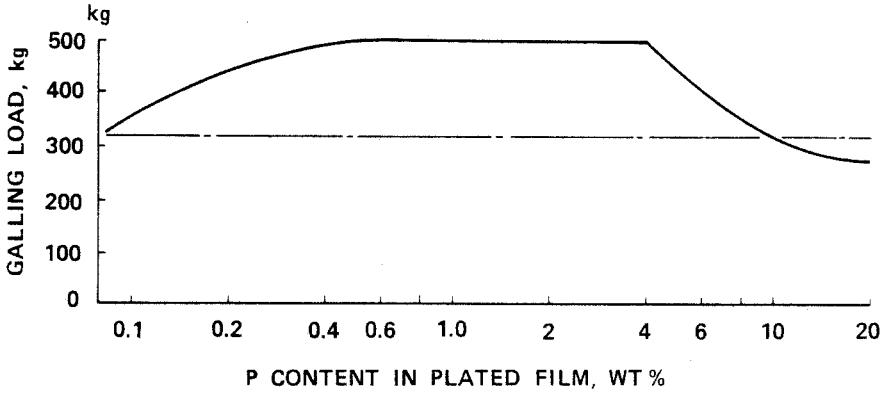
FIG. 2 is a diagram showing galling load (kilogram) as a function of the phosphorus content (% by weight) in plated iron-phosphorus films.

When it is intended to plate a slide member with an iron-phosphorus film, it is advantageous in view of crack prevention, abrasion resistance and galling resistance to use the plating bath of the present invention to form a plated film having a phosphorus content of 0.1 to 9.9% by weight. It is seen from FIGS. 1 and 2 that the abrasion resistance of a plated film is deteriorated when the phosphorus content in the plated film is less than 0.7%, and galling resistance is deteriorated when the phosphorus content is less than 0.1% or more than 9.9%. The preferred phosphorus content is in the range of from 0.7 to 6%, especially from 0.74 to 2% by weight.

The thickness of the plated iron-phosphorus films is not particularly limited although they are generally formed to a thickness of 1 to 250 μm, preferably 10 to 150 μm. Plated iron-phosphorus films having higher abrasion resistance will be more durable even at a more reduced thickness.

The slide member blanks to be plated with an iron-phosphorus film according to the present invention may be of any desired materials. Most conventional pistons are formed of aluminum alloys such as cast aluminum alloy of designation AC8A T6 and magnesium alloys. Also employable are gray cast iron (FCP1), nodular graphite cast iron, spring steel, tool steel, and stainless steel. The slider materials are not limited to these examples.

The above-mentioned slide member having an iron-phosphorus film plated thereon may be produced by subjecting a slide member blank to any well-known pre-treatment for the particular material used, and then to electroplating in the iron-phosphorus plating bath of the invention with or without interposing a suitable undercoat plating.

The additive effect of aluminum ion will be further described with reference to the results obtained from electroplating of a piston skirt in the present plating bath. It is now assumed that as typical with internal combustion engine pistons, slide members undergo elastic deformation under the action of explosion pressure and inertia force during operation. For the piston skirt provided with a conventional iron-phosphorus plating having poor flexibility, cracks occur in the plating at a first stage when the plating has failed to follow the elastic deformation of the matrix material during operation. Some cracks are parallel and some are perpendicular to the film surface. These cracks propagate at a second stage. When parallel cracks propagate to the surface, the cracked part is removed from the film. When perpendicular cracks propagate down to the matrix, the cracked part is removed from the matrix. Pieces thus peeled away scratch the film at a third stage when they are moved between the sliding surfaces of the piston skirt and the cylinder bore. Thus a marked damage develops in the sliding direction of the piston skirt, leading to a failure known as piston scuff. This problem can be overcome by improving the plating film to a sufficient extent of flexibility to follow the deformation of the matrix. The present invention is successful in this attempt by adding aluminum ion to the plating bath, allowing finer grains to grow in the plating film which thus exhibits sufficient elongation. This effect has been demonstrated by an actual engine test. Piston scuff can be prevented by the addition of aluminum ion to the iron-phosphorus plating bath.

Figure 3:
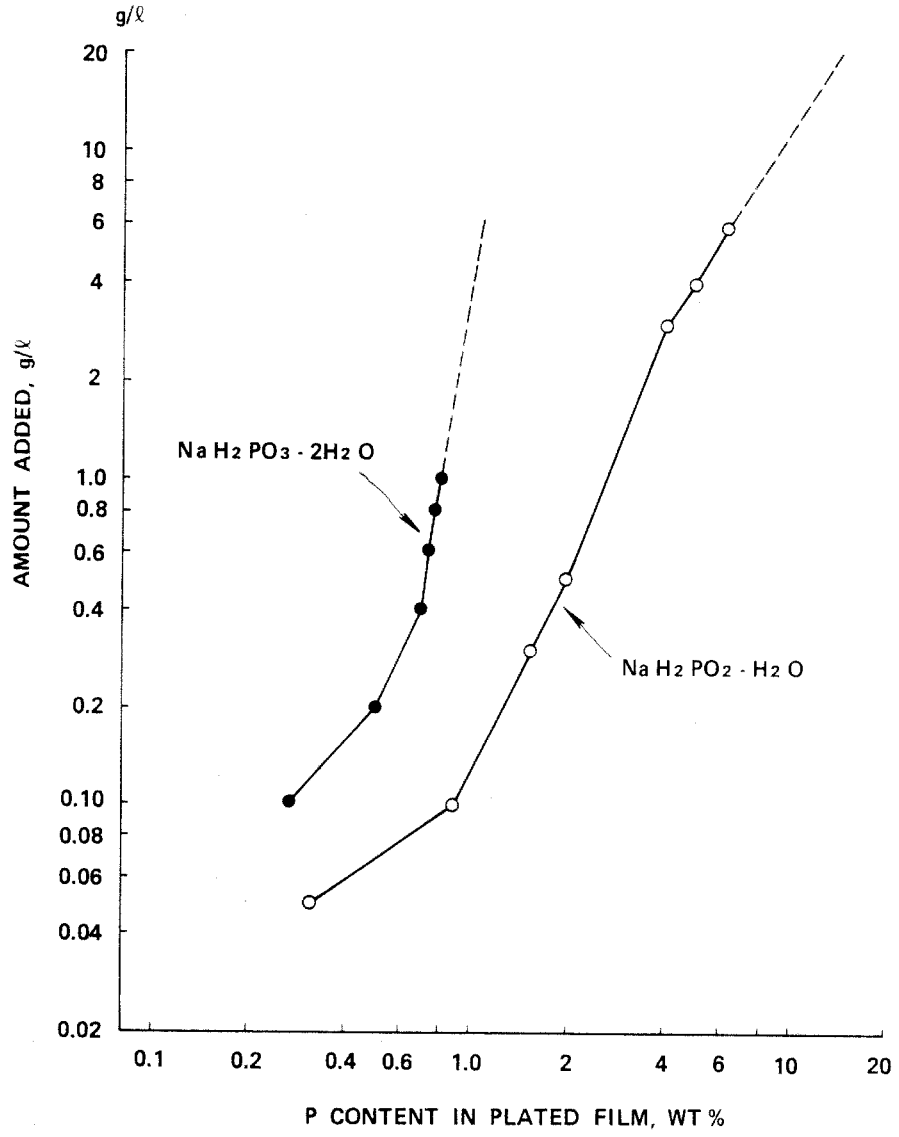
FIG. 3 is a diagram showing the phosphorus content (% by weight) in plated iron-phosphorus films as a function of the concentrations (gram/liter) of $NaH_2PO_2.H_2O$ and $NaH_2PO_3.2H_2O$ in plating baths.

The hypophosphites and phosphites in the present baths will be further described with respect to their effect. The amount of hypophosphites and phosphites added in the bath is closely related to the phosphorus content in the resulting plated film. As seen from FIG. 3, for the same amount added, hypophosphite results in a higher phosphorus content of the film than phosphite. Since the optimum phosphorus content that ensures galling resistance and abrasion resistance is in the range of from 0.74 to 2% by weight, the phosphite bath is more advantageous to produce a plated film having the optimum phosphorus content, and thus more suitable in large scale production.

The slide member having deposited an iron-phosphorus film with a P content of 0.1 to 9.9% by weight may be used as deposited or after any appropriate post-treatment if necessary. Such post-treatments include a heat treatment at 200° to 700° C. for 1 to 2 hours to increase the hardness of the plating film, quenching of the plated film to increase its hardness, infiltration of the plated film with nitride or boride, and application of a lubricating film such as tin or lead plating on the plated film.

Examples of the slide members to which the present invention is applicable include pistons, piston rings, bearings, bored cylinders, piston rods, shafts, shift forks, carburetor throttle valves, brake drums, clutch housings, clutch diaphragms, springs, and the like. Mating members to come in sliding contact with the present slide members may generally be formed of any desired materials. The mating members are preferably formed of high silicon aluminum alloy A390 T6 because the present slide members exhibit the best performance when combined therewith.

Examples of the present invention are given below along with comparative examples. The examples are included merely to aid in the understanding of the invention and not to limit the invention thereto. In the tables, "E" and "CE" correspond to examples and comparative examples, respectively. "Dk" is an abbreviation of cathode current density.

EXAMPLE 1

| Ingredients | gram/liter |
|---|---|
| $FeSO_4.7H_2O$ | 250 |
| $NH_4Cl$ | 50 |
| $H_3BO_3$ | 20 |
| $NH_4F.HF$ | 5 |
| $Al_2(SO_4)_3.14–18H_2O$ | 1 |
| $NaH_2PO_2.H_2O$ | 0.1 |
| pH 1.8 | |

EXAMPLE 2

| Ingredients | gram/liter |
|---|---|
| $FeCl_2.4H_2O$ | 160 |
| $(NH_4)_2SO_4$ | 100 |
| $H_3BO_3$ | 20 |
| $NH_4F.HF$ | 5 |
| $Al_2(SO_4)_3.14–18H_2O$ | 5 |
| $NaH_2PO_2.H_2O$ | 3 |
| pH 1.4 | |

EXAMPLE 3

| Ingredients | gram/liter |
|---|---|
| $Fe(NH_2SO_3)_2$ | 50 (as Fe) |
| $NH_4Cl$ | 5 |
| $NH_4F.HF$ | 5 |
| $Al_2(SO_4)_3.14–18H_2O$ | 2 |
| $NaH_2PO_2.H_2O$ | 10 |
| $NaH_2PO_3.2H_2O$ | 1 |
| pH 2.4— | |

COMPARATIVE EXAMPLE 1

| Ingredients | gram/liter |
|---|---|
| $FeCl_2.4H_2O$ | 80 |
| $FeSO_4.7H_2O$ | 100 |
| $(NH_4)_2SO_4$ | 25 |
| $NaH_2PO_2.H_2O$ | 10 |
| pH 1.4 | |

Workpieces of aluminum alloy AC8A T6 were pretreated by a known method and then electroplated in the plating baths of Examples 1 to 3 at a temperature of 60° and a cathode current density of 4 A/dm$^2$, forming an iron-phosphorus film of 30 μm thick.

For comparison purposes, a similarly pre-treated workpiece of aluminum alloy AC8A T6 was electroplated in the plating bath of Comparative Example 1 at a temperature of 55° C. and a cathode current density of 10 A/dm$^2$, forming an iron-phosphorus film of 30 μm thick.

The resulting iron-phosphorus plated films were examined for appearance, hardness, and phosphorus content. The results are shown in Table 1.

The plated films were cut to expose a section, which was etched with 5% Nital etchant for 2 seconds and then examined for cracks under a metallurgical microscope (400X). The results are also reported in Table 1.

TABLE 1

| | Surface appearance | Hardness HV | Content of P, % | Cracks |
|---|---|---|---|---|
| E1 | not bright, but smooth and uniform | 350 | 0.9 | no |
| E2 | semi-bright and uniform | 560 | 4.0 | no |
| E3 | bright and uniform | 620 | 7.2 | no |
| CE1 | bright and uniform | 683 | 8.3 | cracks |

Workpieces of aluminum alloy AC8A T6 were pretreated by a known method and then electroplated in the foregoing plating baths under similar conditions, forming an iron-phosphorus film of 20 μm thick. The resulting specimens were examined by a rotary bending fatigue test on metal material according to JIS Z 2274. The results are shown in Table 2.

TABLE 2

| | Relative index |
|---|---|
| Workpiece | 100 |
| E 1 | 97 |
| E 2 | 98 |
| E 3 | 95 |
| CE1 | 65 |

As seen from the data of Table 2, the plated iron-phosphorus films resulting from the present plating baths have good mechanical properties.

EXAMPLE 4

| Ingredients | gram/liter |
|---|---|
| $FeSO_4.7H_2O$ | 250 |
| $(NH_4)_2SO_4$ | 100 |
| $NaH_2PO_3.2H_2O$ | 1 |
| pH 2.1 | |

EXAMPLE 5

| Ingredients | gram/liter |
|---|---|
| $FeSO_4.7H_2O$ | 250 |
| $NH_4Cl$ | 50 |
| $H_3BO_3$ | 20 |
| $NaH_2PO_3.2H_2O$ | 2 |
| pH 1.8 | |

EXAMPLE 6

| Ingredients | gram/liter |
|---|---|
| $FeCl_2.4H_2O$ | 220 |
| $NH_4F.HF$ | 10 |
| $Al_2(SO_4)_3.14–18H_2O$ | 5 |
| $H_3PO_3$ | 1.5 |
| pH 1.2 | |

COMPARATIVE EXAMPLE 2

| Ingredients | gram/liter |
|---|---|
| $FeCl_2.4H_2O$ | 80 |
| $FeSO_4.7H_2O$ | 100 |
| $NaH_2PO_2.H_2O$ | 10 |
| pH 1.4 | |

Workpieces of aluminum alloy AC8A T6 were pretreated by a known method and then electroplated in the plating baths of Examples 4 to 6 at a temperature of 60° C. and a cathode current density of 4 A/dm$^2$, forming an iron-phosphorus film of 20 μm thick.

For comparison purposes, a similarly pre-treated workpiece of aluminum alloy AC8A T6 was electroplated in the plating bath of Comparative Example 2 at a temperature of 55° C. and a cathode current density of 10 A/dm$^2$, forming an iron-phosphorus film of 20 μm thick.

The resulting iron-phosphorus plated films were examined for appearance, hardness, and phosphorus content. The results are shown in Table 3.

The plated films were cut to expose a section, which was etched with 5% Nital etchant for 2 seconds and then examined for cracks under a metallurgical microscope (400X). The results are also reported in Table 3.

TABLE 3

| | Surface appearance | Hardness HV | Content of P, % | Cracks |
|---|---|---|---|---|
| E4 | not bright, but smooth and uniform | 469 | 1.0 | no |
| E5 | semi-bright and uniform | 537 | 2.2 | no |
| E6 | not bright, but smooth and uniform | 553 | 1.5 | no |
| CE2 | bright and uniform | 683 | 8.3 | cracks |

Workpieces of aluminum alloy AC8A T6 were pretreated by a known method and then electroplated in the foregoing plating baths under similar conditions, forming an iron-phosphorus film of 20 μm thick. The resulting specimens were examined by a rotary bending fatigue test on metal material according to JIS Z 2274. The results are shown in Table 4.

TABLE 4

| | Relative index |
|---|---|
| Workpiece | 100 |
| E 4 | 98 |
| E 5 | 97 |
| E 6 | 98 |
| CE2 | 65 |

As seen from the data of Table 4, the plated iron-phosphorus films resulting from the present plating baths have good mechanical properties.

EXAMPLE 7

| Ingredients | gram/liter |
|---|---|
| $FeSO_4.7H_2O$ | 250 |
| $(NH_4)_2SO_4$ | 100 |
| $NaH_2PO_3.2H_2O$ | 1 |
| C-BN | 30 |
| pH 2.1 | |

EXAMPLE 8

| Ingredients | gram/liter |
|---|---|
| $FeCl_2.4H_2O$ | 160 |
| $(NH_4)_2SO_4$ | 100 |
| $H_3BO_3$ | 20 |
| $NH_4F.HF$ | 5 |
| $Al_2(SO_4)_3.14–18H_2O$ | 5 |
| $NaH_2PO_2.H_2O$ | 3 |
| $Na_2ZrF_6$ | 2 |
| Polytetrafluoroethylene | 25 |

-continued

| Ingredients | gram/liter |
|---|---|
| pH 1.4 | |

Steel plates were electroplated in the plating baths of Examples 7 and 8 at a temperature of 60° C. and a cathode current density of 4 A/dm$^2$ with stirrer agitation. There were obtained composite plated iron-phosphorus films having a good appearance and having water-insoluble particles of C-BN and polytetrafluoroethylene uniformly dispersed and codeposited therein. The composite plated films showed good abrasion resistance.

EXAMPLE 9

A piston body formed of aluminum alloy of designation AC8A T6 was pre-treated by the conventional techniques of zinc replacement and copper cyanide strike plating, and then electroplated in an iron-phosphorus plating bath of the following composition, forming an iron-phosphorus film having a phosphorus content of 1.0% by weight to a thickness of 30 μm.

The thus obtained slide member or piston was combined with a bored cylinder of aluminum alloy of designation A390 T6 which had been etched by electrolytic polishing or chemical polishing, and then tested for abrasion and galling as described later.

Iron-phosphorus plating bath

| | gram/liter |
|---|---|
| Composition | |
| $FeSO_4.7H_2O$ | 250 |
| $(NH_4)_2SO_4$ | 100 |
| $NaH_2PO_3.2H_2O$ | 1 |
| $K_2TiF_6$ | 2 |
| Conditions | |
| pH 2.1 | |
| Temperature 60° C. | |
| Dk 4 A/dm$^2$ | |

EXAMPLE 10

A piston body formed of aluminum alloy of designation AC8A T6 was pre-treated by the conventional techniques of zinc replacement and copper cyanide strike plating, and then electroplated in an iron-phosphorus plating bath of the following composition, forming an iron-phosphorus film having a phosphorus content of 4.0% by weight to a thickness of 30 μm.

The thus obtained slide member or piston was combined with a bored cylinder of aluminum alloy of designation A390 T6 which had been etched by electrolytic polishing or chemical polishing, and then tested for abrasion and galling as described later.

Iron-phosphorus plating bath

| | gram/liter |
|---|---|
| Composition | |
| $FeCl_2.4H_2O$ | 160 |
| $(NH_4)_2SO_4$ | 100 |
| $H_3BO_3$ | 20 |
| $NH_4F.HF$ | 5 |
| $Al_2(SO_4)_3.14–18H_2O$ | 5 |
| $NaH_2PO_2.H_2O$ | 3 |
| $Na_2ZrF_6$ | 2 |
| Conditions | |
| pH 1.4 | |

-continued

| | gram/liter |
|---|---|
| Temperature 60° C. | |
| Dk 4 A/dm$^2$ | |

EXAMPLE 11

The plating and testing procedures of Example 9 were repeated except that $K_2TiF_6$ was omitted from the plating bath.

EXAMPLE 12

The plating and testing procedures of Example 10 were repeated except that $Na_2ZrF_6$ was omitted from the plating bath.

COMPARATIVE EXAMPLE 3

A piston body formed of aluminum alloy of designation AC8A T6 was combined with a bored cylinder of grey cast iron of designation FC 23, and then tested for abrasion and galling.

COMPARATIVE EXAMPLE 4

A piston body formed of aluminum alloy of designation AC8A T6 was combined with a bored cylinder of aluminum alloy of designation A390 T6 which had been etched by electrolytic polishing, and then tested for abrasion and galling.

COMPARATIVE EXAMPLE 5

A piston body formed of aluminum alloy of designation AC8A T6 which had been electroplated with an iron film to a thickness of 30 μm was combined with a bored cylinder of aluminum alloy of designation A390 T6 which had been etched by electrolytic polishing, and then tested for abrasion and galling.

The abrasion test used a type LFW-1 friction abrasion tester to frictionally abrade the plated film on the piston body at a sliding speed of 0.3 m/sec. and a contact pressure of 400 kg/cm$^2$. The abrasion resistance was evaluated in terms of abrasion depth. In the galling test, a friction abrasion tests of Mechanical Testing Institute type was operated at a sliding speed of 1 m/sec. The galling resistance was evaluated in terms of galling load. The results are shown in Table 5.

TABLE 5

| Example | Abrasion depth, μm | Galling load, kg |
|---|---|---|
| E9 | 1.7 | >500 |
| E10 | 0.7 | 480 |
| E11 | 3.4 | >500 |
| E12 | 1.4 | 480 |
| CE3 | 43 | 450 |
| CE4 | 115 | — |
| CE5 | 8 | 320 |

The plated films of Examples 9 to 12 were found to be free of cracks.

EXAMPLE 13

A piston body formed of aluminum alloy of designation AC8P T6 was pre-treated by the conventional techniques of zinc replacement and copper cyanide strike plating, and then electroplated in an iron-phosphorus plating bath of the following composition, forming an iron-phosphorus film having a phosphorus content of 1.0% by weight to a thickness of 30 μm.

The thus obtained slide member or piston was combined with a bored cylinder of aluminum alloy of designation A390 T6 which had been etched by electrolytic polishing or chemical polishing, and then tested for abrasion and galling.

Iron-phosphorus plating bath

| | gram/liter |
|---|---|
| Composition | |
| $FeSO_4.7H_2O$ | 250 |
| $(NH_4)_2SO_4$ | 100 |
| $NaH_2PO_3.2H_2O$ | 1 |
| $K_2TiF_6$ | 2 |
| SiC | 50 |
| Conditions | |
| pH 2.1 | |
| Temperature 60° C. | |
| Dk 4 A/dm$^2$ | |

EXAMPLE 14

A piston body formed of aluminum alloy of designation AC8P T6 was pre-treated by the conventional techniques of zinc replacement and copper cyanide strike plating, and then electroplated in an iron-phosphorus plating bath of the following composition, forming an iron-phosphorus film having a phosphorus content of 4.0% by weight to a thickness of 30 μm.

The thus obtained slide member or piston was combined with a bored cylinder of aluminum alloy of designation A390 T6 which had been etched by electrolytic polishing or chemical polishing, and then tested for abrasion and galling.

Iron-phosphorus plating bath

| | gram/liter |
|---|---|
| Composition | |
| $FeCl_2.4H_2O$ | 160 |
| $(NH_4)_2SO_4$ | 100 |
| $H_3BO_3$ | 20 |
| $NH_4F.HF$ | 5 |
| $Al_2(SO_4)_3.14–18H_2O$ | 5 |
| $NaH_2PO_2.H_2O$ | 3 |
| C-BN | 10 |
| Conditions | |
| pH 1.4 | |
| Temperature 60° C. | |
| Dk 4 A/dm$^2$ | |

EXAMPLES 15–22

Following the procedure of Example 14, a series of composite plating runs were carried out as shown in Table 6. The resulting composite plated films were also tested for abrasion and galling.

COMPARATIVE EXAMPLE 6

A piston body formed of aluminum alloy of designation AC8P T6 was combined with a bored cylinder of grey cast iron of designation FC 23, and then tested for abrasion and galling.

COMPARATIVE EXAMPLE 7

A piston body formed of aluminum alloy of designation AC8P T6 was combined with a bored cylinder of aluminum alloy of designation A390 T6 which had been etched by electrolytic polishing, and then tested for abrasion and galling.

COMPARATIVE EXAMPLE 8

A piston body formed of aluminum alloy of designation AC8P T6 which had been electroplated with an iron film to a thickness of 30 μm was combined with a bored cylinder of aluminum alloy of designation A390 T6 which had been etched by electrolytic polishing, and then tested for abrasion and galling.

COMPARATIVE EXAMPLE 9

The procedure of Comparative Example 8 was repeated except that the iron film was replaced by a hard chromium plating film.

The abrasion test used a type LFW-1 friction abrasion tester to frictionally abrade the plated film on the piston body. The abrasion resistance was evaluated in terms of abrasion depth. The galling test used a friction abrasion tester of Mechanical Testing Institute type. The galling resistance was evaluated in terms of galling load. The results are shown in Table 6.

TABLE 6

| | | Abrasion & Galling Tests | | | |
|---|---|---|---|---|---|
| | | Abrasion test | | Galling test | |
| Example | Material* | Mild (load 60 kg) | Severe (load 150 kg) | Mild (good lub.) | Severe (short lub.) |
| CE 6 | Aluminum AC8P T6 | 43μ | 300μ | 450 kg | — |
| CE 7 | Aluminum AC8P T6 | 115μ | — | — | — |
| CE 8 | Fe plating | 8μ | ≧100μ | 320 kg | — |
| CE 9 | Hard chromium plating | 2μ | 10μ | — | — |
| E13 | Fe—P(1% + Ti) + SiC[50 g/l] | 1μ | 2μ | — | — |
| E14 | Fe—P(4%) + CBN[10 g/l] | 6μ | 40μ | — | — |
| E15 | Fe—P(1% + Ti) + SiC[20 g/l] | 1.5μ | 4μ | — | — |
| E16 | Fe—P(1% + Ti) + SiC[10 g/l] | 2μ | 6μ | — | — |
| E17 | Fe—P(1% + Ti) + SiC[5 g/l] | 3μ | 15μ | — | — |
| E18 | Fe—P(1%) + Mo[50 g/l] | 2μ | — | ≧500 kg | 450 kg |
| E19 | Fe—P(1%) + Mo[20 g/l] | 3μ | — | ≧500 kg | 400 kg |
| E20 | Fe—P(1%) + Pb[20 g/l] | 4μ | — | — | 500 kg |
| E21 | Fe—P(1%) + Sr[20 g/l] | 4μ | — | — | 500 kg |
| E22 | Fe—P(1%) + PTFE[10 g/l] | 3μ | — | — | 460 kg |

*%: % by weight of the plated film
PTFE: polytetrafluoroethylene

What is claimed is:

1. An iron-phosphorus electroplating bath comprising a ferrous ion, hypophosphorous acid and/or a hypophosphite, and an aluminum ion, wherein the ferrous ion is present in an amount of 20 to 80 grams, the hypophosphorous acid and/or hypophosphite is present in an amount of 0.01 to 15 grams calculated as $NaH_2PO_2.H_2O$, and the aluminum ion is present in an amount of 0.05 to 5 grams per liter of the bath.

2. The plating bath according to claim 1, further comprising 5 to 500 grams per liter of the bath of at least one water-insoluble material selected from the group consisting of metals, water-insoluble inorganic and organic fine particulates, and fibers.

3. The plating bath according to claim 1, further comprising at least one member selected from the group consisting of titanium compounds and zirconium compounds.

4. A method for electroplating an iron-phosphorus film on a workpiece, comprising immersing the workpiece in a plating bath as set forth in claim 1 and effecting electroplating at a cathode current density of 0.5 to 30 $A/dm^2$ and a temperature of 10° to 80° C.

5. The method according to claim 4, wherein the thickness of the iron-phosphorus film is 1 to 250 μm.

6. The plating bath according to claim 1, wherein the pH is 0.5 to 2.5.

7. An iron phosphorus electroplating bath comprising a ferrous ion and phosphorous acid and/or a phosphite as essential ingredients, wherein the ferrous ion is present in an amount of 20 to 80 grams, and the phosphorous acid and/or phosphite is present in an amount of 0.01 to 20 grams calculated as $NaH_2PO_3.2H_2O$ per liter of the bath.

8. The plating bath according to claim 7, further comprising 0.05 to 5 grams of aluminum ion per liter of the bath.

9. The plating bath according to claim 7, further comprising 5 to 500 grams per liter of the bath of at least one water-insoluble material selected from the group consisting of metals, water-insoluble inorganic and organic fine particulates, and fibers.

10. The plating bath according to claim 7, further comprising 0.05 to 10 grams per liter of the bath of at least one member selected from the group consisting of titanium compounds and zirconium compounds.

11. A method for electroplating an iron-phosphorus film on a workpiece, comprising immersing the workpiece in a plating bath as set forth in claim 7, and effecting electroplating at a cathode current density of 0.5 to 30 $A/dm^2$ and a temperature of 10° to 80° C.

12. The method according to claim 11, wherein the thickness of the iron-phosphorus film is 1 to 250 μm.

13. The plating bath according to claim 7, wherein the pH is 0.5 to 2.5.

14. An iron-phosphorus electroplating bath comprising a ferrous ion, hypophosphorous acid and/or a hypophosphite, phosphorous acid and/or a phosphite, and an aluminum ion, wherein the ferrous ion is present in an amount of 20 to 80 grams, the hypophosphorous acid and/or hypophosphite is present in an amount of 0.01 to 15 grams calculated as $NaH_2PO_2.H_2O$, the phosphorous acid and/or phosphite is present in an amount of 0.01 to 20 grams calculated as $NaH_2PO_3.2H_2O$, and the aluminum ion is present in an amount of 0.05 to 5 grams per liter of the bath.

15. The plating bath according to claim 14, wherein the pH is 0.5 to 2.5.

16. A method for making a slide member, comprising forming an electroplated iron-phosphorus film having a phosphorus content of 0.1 to 9.9% by weight on a slide member blank using an iron-phosphorus electroplating bath comprising a ferrous ion, hypophosphorous acid and/or a hypophosphite, and an aluminum ion, wherein the ferrous ion is present in an amount of 20 to 80 grams, the hypophosphorous acid and/or hypophosphite is present in an amount of 0.01 to 15 grams calculated as $NaH_2PO_2.H_2O$, and the aluminum ion is present in an amount of 0.05 to 5 grams per liter of the bath.

17. A method for making a slide member, comprising forming an electroplated iron-phosphorus film having a phosphorus content of 0.1 to 9.9% by weight on a slide member blank using an iron-phosphorus electroplating bath comprising a ferrous ion and phosphorous acid and/or a phosphite, wherein the ferrous ion is present in an amount of 20 to 80 grams, and the phosphorous acid and/or phosphite is present in an amount of 0.01 to 20 grams calculated as $NaH_2PO_3.2H_2O$ per liter of the bath.

* * * * *